US007348730B2

(12) United States Patent
Kakisaka et al.

(10) Patent No.: US 7,348,730 B2
(45) Date of Patent: Mar. 25, 2008

(54) METAL HALIDE LAMP AND LUMINAIRE

(75) Inventors: Shunsuke Kakisaka, Osaka (JP); Hiroshi Nohara, Hyogo (JP); Atsushi Utsubo, Osaka (JP); Yukiya Kanazawa, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 57 days.

(21) Appl. No.: 10/582,844

(22) PCT Filed: Dec. 20, 2004

(86) PCT No.: PCT/JP2004/019478

§ 371 (c)(1),
(2), (4) Date: Jun. 14, 2006

(87) PCT Pub. No.: WO2005/062341

PCT Pub. Date: Jul. 7, 2005

(65) Prior Publication Data

US 2007/0145898 A1 Jun. 28, 2007

(30) Foreign Application Priority Data

Dec. 22, 2003 (JP) ..... 2003-424169

(51) Int. Cl.
*H01J 61/50* (2006.01)

(52) U.S. Cl. ..... 313/639; 313/25; 313/620; 313/572; 313/573

(58) Field of Classification Search ..... None
See application file for complete search history.

(56) References Cited

U.S. PATENT DOCUMENTS 3,753,019 A * 8/1973 Hellman ..... 313/47
5,973,453 A 10/1999 Van Vliet et al.
6,147,453 A 11/2000 Geijtenbeek et al.
6,300,729 B1 10/2001 Keijser et al.
6,600,267 B1 7/2003 Dotterweich et al.
6,650,054 B2 * 11/2003 Higashi et al. ..... 313/623
2003/0141826 A1 7/2003 Zhu et al.

FOREIGN PATENT DOCUMENTS

EP 0183247 A 11/1985
EP 0 345 417 2/1989
EP 0 583 113 7/1993
JP 5258724 10/1993

* cited by examiner

*Primary Examiner*—Ashok Patel

(57) ABSTRACT he present invention aims at providing a metal halide lamp having a configuration to achieve the following goals: to prevent the lamp from burning out during the life due to a rise in lamp voltage; and to obtain high luminous efficiency at the same time. The metal halide lamp 1 comprises: an arc tube 4 made of translucent ceramic and having a main tube part 6 in which a pair of electrodes 14 is disposed; and an outer tube 3 housing the arc tube 4 therein. $4.0 \leqq L/D \leqq 10.0$, where L (mm) is a length of a space between the electrodes 14 and D (mm) is an internal diameter of the main tube part 6. $R/r \geqq 3.4$, where R (mm) is an internal diameter of the outer tube 3 and r (mm) is an external diameter in the main tube part 6 of the arc tube 4, within a region positionally corresponding to, in a radial direction of the outer tube and the arc tube, the space between the electrodes 14, on a cross-sectional surface where an outer circumference of the arc tube 4 comes closest to an inner circumference of the outer tube 3. $M \leqq 4.0$, where M (mg/cc) is a density of mercury enclosed in the arc tube 4.

6 Claims, 7 Drawing Sheets

FIG.3

| CLASS | INTERNAL DIAMETER R (mm) | R/r | DENSITY OF MERCURY M (mg/cc) | OCCURRENCE OF BURNT-OUT LAMPS | LAMP VOLTAGE RISE(V) | COLOR TEMPERATURE (K) | OCCURRENCE OF OUTER TUBE BREAKAGE | VARIATION OF COLOR TEMPERATURE(K) | ASSESSMENT |
|---|---|---|---|---|---|---|---|---|---|
| A | 20 | 3.1 | 3.0 | YES | 37 | 3950 | 0/5 | 60 | BAD |
| B | | | 4.0 | YES | 38 | 3880 | 0/5 | 70 | BAD |
| C | | | 4.1 | YES | 40 | 3850 | 2/5 | 50 | BAD |
| D | | | 5.0 | YES | 35 | 3920 | 5/5 | 70 | BAD |
| E | 22 | 3.4 | 3.0 | NO | 27 | 3950 | 0/5 | 80 | GOOD |
| F | | | 4.0 | NO | 23 | 4000 | 0/5 | 50 | GOOD |
| G | | | 4.1 | NO | 25 | 4150 | 1/5 | 100 | BAD |
| H | | | 5.0 | NO | 23 | 4080 | 4/5 | 70 | BAD |
| I | 30 | 4.7 | 3.0 | NO | 20 | 4070 | 0/5 | 160 | GOOD |
| J | | | 4.0 | NO | 18 | 4120 | 0/5 | 90 | GOOD |
| K | | | 4.1 | NO | 25 | 3990 | 1/5 | 140 | BAD |
| L | | | 5.0 | NO | 18 | 4110 | 3/5 | 110 | BAD |
| M | 45 | 7.0 | 3.0 | NO | 22 | 4030 | 0/5 | 80 | GOOD |
| N | | | 4.0 | NO | 22 | 4250 | 0/5 | 270 | GOOD |
| O | | | 4.1 | NO | 20 | 4100 | 1/5 | 100 | BAD |
| P | | | 5.0 | NO | 19 | 4280 | 3/5 | 250 | BAD |
| Q | 50 | 7.8 | 3.0 | NO | 16 | 4620 | 0/5 | 620 | BAD |
| R | | | 4.0 | NO | 14 | 4570 | 0/5 | 440 | BAD |
| S | | | 4.1 | NO | 16 | 4480 | 1/5 | 410 | BAD |
| T | | | 5.0 | NO | 20 | 4770 | 2/5 | 840 | BAD |

FIG.4

| L/D | LENGTH BETWEEN ELECTRODES L (mm) | OCCURRENCE OF BURNT-OUT LAMPS | LUMINOUS EFFICIENCY (lm/W) | ASSESSMENT |
|---|---|---|---|---|
| 4.0 | 16 | 0/5 | 115 | VERY GOOD |
| 8.0 | 32 | 0/5 | 128 | VERY GOOD |
| 10.0 | 40 | 0/5 | 131 | VERY GOOD |
| 11.0 | 44 | 1/5 | 130 | GOOD |

METAL HALIDE LAMP AND LUMINAIRE

CROSS-REFERENCE TO RELATED APPLICATIONS

This application is based on application No. 2003-424169 filed in Japan, the contents of which are hereby incorporated by reference.

TECHNICAL FIELD

The present invention relates to a metal halide lamp and a luminaire.

BACKGROUND ART

As to metal halide lamps used with luminaires for, for instance, outdoor lighting and high ceiling lighting, recent years an improvement in luminous efficiency has been strongly desired from the aspect of energy saving.

In response to such a demand, a certain type of ceramic metal halide lamps has been proposed (see, e.g. Published Japanese translation of a PCT application No. 2000-501563). In a ceramic metal halide lamp of this type, translucent ceramic that withstands a high bulb wall loading, namely withstands use at a high temperature, is used as a material for the envelope of the arc tube. Such translucent ceramic is, for example, made of alumina. The arc tube has an elongated shape (L/D>5, when the internal diameter of the arc tube is D and the length of the space (i.e. distance) between the electrodes is L), and cerium iodide ($CeI_3$) and sodium iodide (NaI) are enclosed therein.

It is said that this ceramic metal halide lamp is capable of achieving extremely high luminous efficiency of 111 lm/W-177 lm/W.

As to conventional metal halide lamps, an arc tube is housed in, for example, a hard-glass outer tube. Here, a quartz-glass sleeve is placed between the outer tube and the arc tube so as to surround the arc tube. The sleeve is provided in order to protect the outer tube from being damaged by broken pieces in the case of rupture of the arc tube (see, e.g. Japanese Laid-Open Patent Application Publication No. H05-258724).

As a matter of course, some conventional metal halide lamps have a structure with no sleeve. However, in such conventional metal halide lamps, fluorocarbon resin coating is applied to the outer tube in order to prevent the outer tube breakage. Alternatively, these conventional metal halide lamps are necessarily used with a luminaire equipped with a front glass so that, in the case of breakage of the outer tube, the broken pieces would not fly off, and thus they are never used with a luminaire having no such a frontal shield facing the floor.

In order to achieve high luminous efficiency, it was attempted to produce a ceramic metal halide lamp as described in the above-mentioned reference (Published Japanese translation of a PCT application No. 2000-501563). A quartz-glass sleeve was placed between the outer tube and the arc tube so as to surround the entire arc tube, as in the above case of the conventional metal halide lamp. When such lamps were prepared and their lamp characteristics were examined, an unexpected problem was posed: due to a rise in the lamp voltage, some of the prepared lamps burned out during the rated life.

With an analysis and examination of the cause of the above problem, the present inventors found traces that, in the burnt-out lamps, the internal surface of the arc tube intensely reacted with the metal halides enclosed in the arc tube. Accordingly, the rise in lamp voltage is thought to be attributable to a significant increase in liberated halides in the arc tube as a result of the reaction between the metal halides and the ceramic forming the envelope of the arc tube.

Then, the cause of the intensive reaction between the metal halides and the ceramic was examined, and the following was found. The ceramic was used to form the envelope because it is a material that is supposed to withstand use at a high temperature. However, the arc tube was made in an elongated shape (e.g. L/D>5) in order to achieve high luminous efficiency, and herewith an arc of the metal halide lamp was formed close to the internal surface of the arc tube during illumination. As a result, the temperature of the ceramic forming the envelope of the arc tube (hereinafter, simply "arc tube temperature") became a far greater than expected value and reached a temperature at which the ceramic intensely reacts with the enclosed metal halides.

After conducting a further analysis and advancing an investigation, the present inventors also found that the increase in the arc tube temperature was not only attributable to the shape of the arc tube. During illumination, the heat of the arc tube is kept by the sleeve, which accelerates the arc tube temperature increase. As with the conventional metal halide lamp, this has not been acknowledged as a practical problem, and this finding went beyond the expectations of the inventors.

It also became clear that the phenomenon in which the arc tube temperature rises exceptionally high could occur not only when L/D>5, and this phenomenon can be observed when a relational expression of $L/D \geqq 4$ is satisfied.

In order to solve this problem, simply the outer tube could be made large so that more space is provided between the arc tube and the sleeve. However, this would sacrifice the compactness of the metal halide lamp. Instead, a structure having no sleeve may be adopted. In this case, for example, fluorocarbon resin coating would be applied to the outer tube. However, the fluorocarbon resin coating has limits in its heat resistance, and therefore cannot be applied to all lamps. In the case where even this fluorocarbon resin coating is not applied, the outer tube may possibly break as a result of the arc tube rupture as described above. This was considered to cause a restriction on the applicability of the metal halide lamp to luminaires.

DISCLOSURE OF THE INVENTION

The present invention aims at providing a metal halide lamp and a luminaire using the same, both having a configuration to achieve the following goals: (i) to prevent the metal halide lamp from burning out due to a rise in lamp voltage during the rated life, and at the same time (ii) to obtain high luminous efficiency and compactness.

In order to solve the above problem, the inventors of the present invention earnestly concentrated their thoughts, and consequently the following technical ideas were newly gained.

The metal halide lamp of the present invention comprises: an arc tube made of translucent ceramic and having a main tube part in which a pair of electrodes are disposed; and an outer tube housing the arc tube therein. Here, $4.0 \leqq L/D\ 10.0$, where L is a length of a space between the electrodes and D is an internal diameter of the main tube part. $R/r \geqq 3.4$, where R is an internal diameter of the outer tube and r is an external diameter of the main tube part, within a region positionally corresponding to, in a radial direction of the outer tube and the arc tube, the space between the electrodes, on a cross-sectional surface where an outer circumference of the arc tube comes closest to an inner circumference of the outer tube. M≦4.0, where M (mg/cc) is a density of mercury enclosed in the arc tube.

Note that the "internal diameter" phrased in this specification means an average internal diameter of, in the main tube part, a portion across the region positionally corresponding to the space between the electrodes. In addition, the "region positionally corresponding to, in a radial direction of the outer tube and the arc tube, the space between the electrodes" means a region sandwiched by two imaginary planes. Each of the imaginary planes lies at a tip of one of the electrodes, and is perpendicular to a central axis in a longitudinal direction of the electrode.

According to the above configuration, the occurrence of burnt-out lamps during the rated life due to a lamp voltage rise can be prevented while high luminous efficiency is obtained. Furthermore, even when the arc tube breaks, the breakage of the outer tube caused by the broken pieces of the arc tube can be eliminated. This, in turn, eliminates the conventional need for providing, in the outer tube, a sleeve surrounding the arc tube, which leads to downsizing of the metal halide lamp.

As with the above metal halide lamp, R/r may be at 7.0 or smaller.

The above configuration facilitates the maintenance of the discharge while obtaining high luminous efficiency.

As with the above metal halide lamp, a sodium halide and at least one of a cerium halide and a praseodymium halide may be enclosed in the arc tube.

According to the above configuration, even when a sodium (Na) halide and at least one of a cerium (Ce) halide and a praseodymium (Pr) halide are enclosed in the arc tube in order to obtain higher luminous efficiency, the arc tube is adequately kept heated and therefore the vapor pressures of the enclosed metals were maintained at high levels without any downturns.

As with the above metal halide lamp, a degree of vacuum inside the outer tube may be no more than $1\times10^3$ Pa at 300 K.

The above configuration prevents the heat of the arc tube from being transferred to the outer tube through the gas enclosed in the outer tube and released to the outside of the metal halide lamp. Consequently, a decrease in luminous efficiency can be prevented.

Furthermore, as with the above metal halide lamp, an external surface of the arc tube may directly face an internal surface of the outer tube.

The luminaire of the present invention comprises: a metal halide lamp recited in one of claims 1 to 7 of the present invention; and a lighting circuit for illuminating the metal halide lamp.

According to the above configuration, the occurrence of burnt-out lamps during the rated life due to a lamp voltage rise can be prevented while high luminous efficiency is obtained.

BRIEF DESCRIPTION OF THE DRAWINGS

FIG. 3 shows results of experiments conducted in order to determine the operational effectiveness of the metal halide lamp;

FIG. 4 shows results of another experiment conducted in order to determine the operational effectiveness of the metal halide lamp;

BEST MODES OF CARRYING OUT THE INVENTION

The following will describe the best modes for carrying out the present invention, with reference to the drawings.

1. First Embodiment

Figure 1:
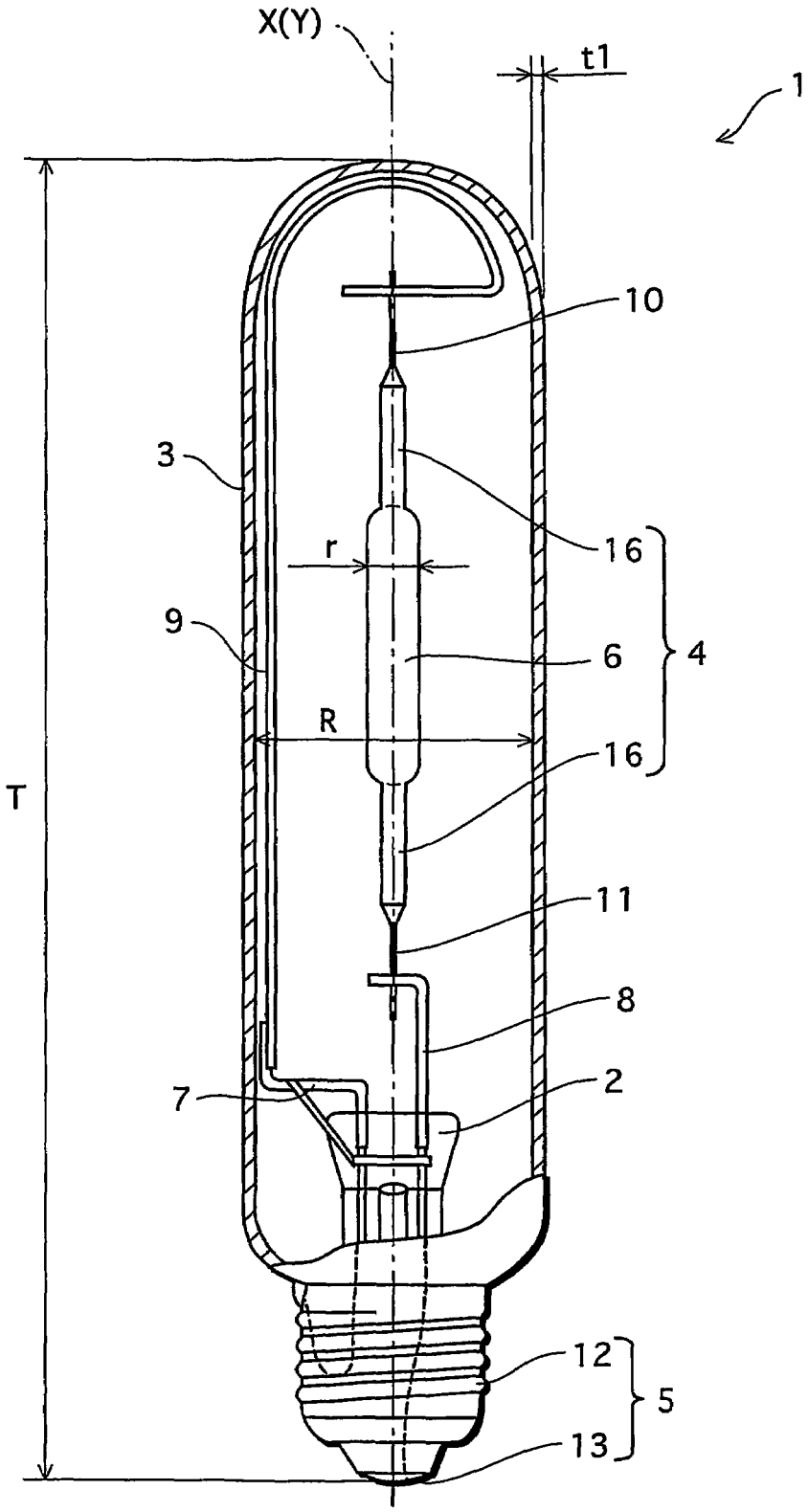
FIG. 1 is a front view of a metal halide lamp according to a first embodiment of the present invention, with a part cut away to reveal the internal arrangements.

FIG. 1 shows a metal halide lamp (a ceramic metal halide lamp) 1 according to a first embodiment of the present invention. The metal halide lamp 1 with rated lamp wattage of 150 W has an overall length T of 160 mm-200 mm (e.g. 180 mm). The metal halide lamp 1 comprises an outer tube 3, an arc tube 4, and a base 5. The outer tube 3 is cylindrical, and an end of the outer tube 3 is closed and round in shape while the other end is closed by fixing a stem tube 2 thereto. The arc tube 4 is made of translucent ceramic such as polycrystalline alumina, and disposed in the outer tube 3. The base 5 is a screw base (Edison screw base), and fixed to the outer tube 3 at the end on the stem tube 2 side. Note that the central axis X in the longitudinal direction of the arc tube 4 substantially coincides with the central axis Y in the longitudinal direction of the outer tube 3.

The outer tube 3 is made of, for example, hard glass. A relational expression of 3.4≦R/r≦7.0 is satisfied, where R is the internal diameter (mm) of the outer tube 3 and r is the external diameter (mm) in a main tube part 6 of the arc tube 4, within a region positionally corresponding to, in a radial direction of the outer tube and the arc tube, the space between a pair of electrodes 14 (to be hereinafter described), on a cross-sectional surface where the outer circumference of the main tube part comes closest to the inner circumference of the outer tube 6. Namely, on the cross-sectional surface, the external diameter r in the main tube part 6 becomes maximum. A wall thickness $t_1$ of the outer tube 3 should be determined so as to provide strength to withstand an external shock incurred during replacement of the lamp and transportation. Yet, the wall thickness $t_1$ should be limited to the degree that does not lead to high production costs and an excessive increase in weight of the lamp. In view of these conditions, it is desirable the wall thickness $t_1$ of the outer tube 3 be determined case by case within the range of, for example, 0.6 mm-1.2 mm. The inside of the outer tube 3 is kept in vacuum at a pressure of $1\times10^3$ Pa or lower (e.g. $1\times10^{-2}$ Pa) at 300 K. Within the outer tube 3, one or more getters (not shown) are provided at appropriate locations in order to maintain the high vacuum condition during the life.

Two stem wires 7 and 8 are single metal wires, each formed by joining together a plurality of metal wires made of different materials. A part of each the stem wires 7 and 8 is fixed onto the stem tube 2. One ends of the respective stem wires 7 and 8 are led into the inside of the outer tube 3, while the other ends are led out from the outer tube 3. The one end of the stem wire 7 is electrically connected, via an electric power supply wire 9, to an external lead wire 10, which is one of two external lead wires 10 and 11 (to be hereinafter described) of the arc tube 3. The one end of the other stem wire 8 is directly and electrically connected to the other external lead wire 11. The other end of the stem wire 7 is electrically connected to a shell 12 of the base 5, while that of the stem wire 8 is electrically connected to an eyelet 13 of the base 5.

Figure 2:
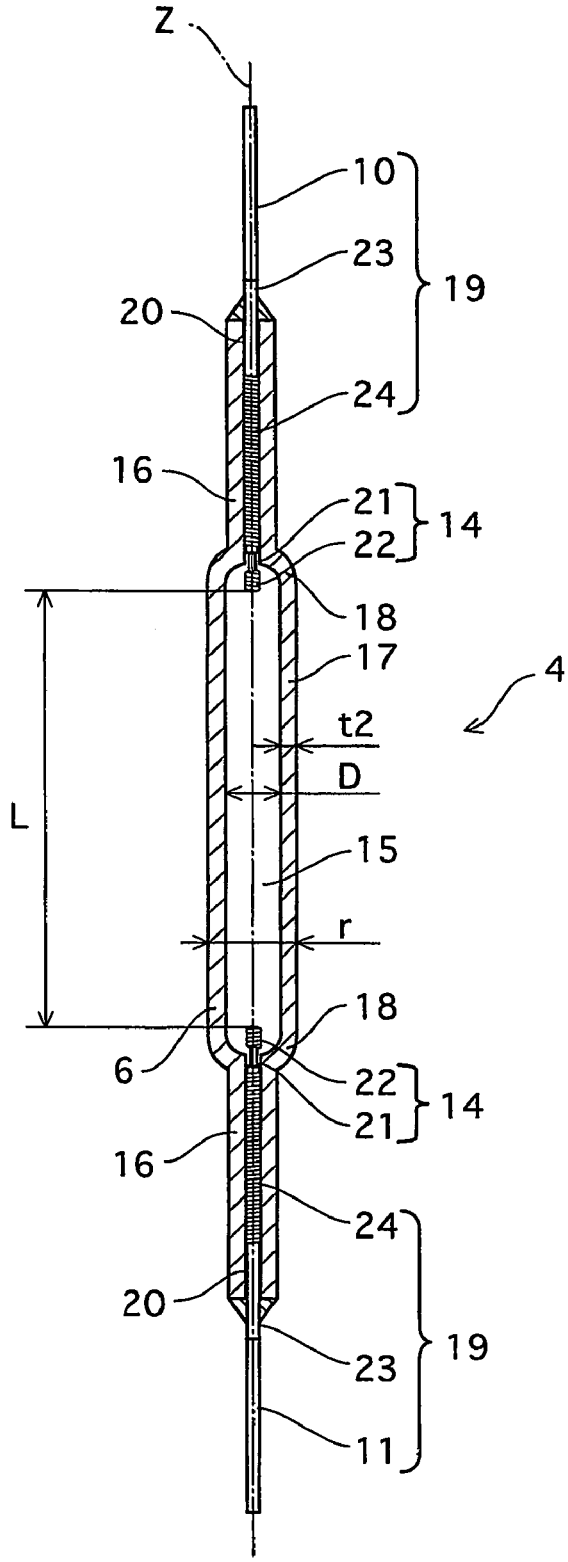
FIG. 2 is a front cross-sectional view of an arc tube used in the metal halide lamp.

As shown in FIG. 2, the arc tube 4 is composed of a main tube part 6 and two cylindrical thin tube parts 16. Within the main tube part 6, a discharge space 15 is formed and a pair of electrodes 14 is placed substantially opposite one another on the approximately same axis Z. Each of the thin tube parts 16 is formed on each end of the main tube part 6.

In the example shown in FIG. 2, the main tube part 6 and thin tube parts 16, making up the ceramic envelope of the arc tube 4, are integrally formed in one piece with no joints. However, the main tube part and thin tube parts may be made of different materials and joined each other by shrink-fit process, and an envelope formed by this means can be used instead. As for the materials used to form the envelope of the arc tube 4, other kinds of translucent ceramics, such as yttrium aluminum garnet (YAG), aluminum nitride, yttria, and zirconia, can be used besides polycrystalline alumina.

The main tube part 6 is made up of a circular cylinder 17 and two rounded portions 18. Each of the rounded portions 18 is formed on each end of the circular cylinder 17. Within a region positionally corresponding to the space between the electrodes 14, on a cross-sectional surface where the outer circumference of the main tube part comes closest to the inner circumference of the outer tube 6, the circular cylinder 17 has: an external diameter r ranging, e.g., 5.0 mm-12.8 mm; an internal diameter D ranging, e.g., 3 mm-10 mm; and a wall thickness $t_2$ ranging, e.g., 1.0 mm-1.4 mm. Each of these dimensions is determined case by case within the above range.

In the example depicted in FIGS. 1 and 2, the central axis in the longitudinal direction of the outer tube 3 and that of the arc tube 4 substantially coincide with each other, and both the outer tube 3 and the main tube part 6 of the arc tube 4 are cylindrical. Therefore, where the outer circumference of the main tube part 6 comes closest to the inner circumference of the outer tube 3 corresponds, in this case, to the entire circular cylinder 17.

An electrode lead-in unit 19, to which one of the electrodes 14 is electrically connected at one end, is inserted in each of the thin tube parts 16. The electrode lead-in units 19 are fixed by glass frit 20 poured from the other ends of the thin tube parts 16 (each located further from the main tube part 6) into the space left between the inside of the thin tube parts 16 and the electrode lead-in units 19 inserted therein. The glass frit 20 is poured so as to get through to 4.5 mm from the edge of the ends.

Each of the electrodes 14 has a tungsten electrode shaft 21, and a tungsten electrode coil 22 mounted on the tip of the electrode shaft 21. The electrode shaft 21 is 0.5 mm in external diameter and 16.5 mm in length. A length L of the space between the electrodes 14 is set so as to satisfy a relational expression of $L/D \geqq 4$. For instance, when the internal diameter D of the arc tube 4 is set within the range of 3 mm-10 mm, the length L is determined case by case within the range of 12 mm-40 mm. In this case, the bulb wall loading of the arc tube 4 is set appropriately within the range of, e.g., 24 $W/cm^2$-34 $W/cm^2$.

The electrode lead-in units 19 are each composed of: a conductive cermet 23; an external lead wire 10 or 11 made of, e.g., niobium; and a molybdenum coil 24. The conductive cermet 23 has an external diameter of 0.92 mm and a length of 18.3 mm. The electrode shaft 21 is connected to one end of the conductive cermet 23, and the other end is led to the outside of the thin tube part 16. One end of the external lead wire 10 or 11 is electrically connected to either the stem wire 8 or the electric power supply wire 9. The coil 24 is wound around the middle portion of the conductive cermet 23.

The conductive cermet 23 is made by mixing metallic powder and ceramic powder and sintering the mixture. Here, the metallic powder is made, e.g., of molybdenum while the ceramic powder, e.g., alumina. The thermal expansion coefficient of the conductive cermet 23 is $7.0\times10^{-6}$ (OC), which is substantially equal to the thermal expansion coefficient of the ceramic forming the envelope of the arc tube 4.

The coil 24 is provided in order to substantially fill spaces left between the thin tube part 16 and the conductive cermet 23 and make it harder for the metal halides enclosed in the arc tube 4 to seep out into the spaces. Note that the electrode lead-in unit 19 used here, comprising the external lead wire 10 or 11, the conductive cermet 23, and the coil 24, is merely an example, and various publicly known electrode lead-in units can be used instead. In addition, metal halides, mercury, and a rare gas are enclosed in the arc tube 4.

The enclosed metal halides are composed of a sodium (Na) halide and at least either one of a cerium (Ce) halide and a praseodymium (Pr) halide.

In order to obtain a desired color temperature and color rendering, publicly known metal halides may be enclosed instead of the above metal halides, or may be added together with the above metal halides.

The mercury to be enclosed can take either form of an elemental mercury or a mercury compound. The mercury is enclosed so as to satisfy a relational expression of $M \leqq 4.0$, where M is the density of mercury enclosed in the arc tube 4. The density M (mg/cc) here is defined as the mass of the mercury divided by the inner volume of the arc tube 4. As a matter of course, the density M can be 0 mg/cc, except for mercury that will be inevitably mixed in.

As the rare gas, for example, a pure argon gas, a pure xenon gas, or a mix of these is enclosed. The amount of the rare gas to be enclosed is set appropriately case by case within the range of 10 kPa-50 kPa regardless of the constituent materials and their ratio.

The following explains experiments conducted in order to determine the operational effectiveness of the metal halide lamp 1.

1.1 R/r and Density M of Mercury

The lamp's operational effectiveness in terms of R/r and the density M of mercury enclosed in the arc tube 4 was examined.

A plurality of the above metal halide lamps 1 (rated lamp wattage: 150 W) were prepared as follows. Five different categories were set up on the basis of R/r. Specifically speaking, these categories were created by variously changing the internal diameter R of the outer tube 3 with 20 mm, 22 mm, 30 mm, 45 mm, and 50 mm, while setting the external diameter r of the main tube part 6 at a constant of 6.4 mm. Note that the internal diameter R is a measurement obtained, within the region sandwiched by the two imaginary planes, on a cross-sectional surface where the outer circumference of the arc tube 4 comes closest to the inner circumference of the outer tube 3. Furthermore, for each category, various classes were set up by changing the density M of enclosed mercury. To be more specific, these classes were set up by changing the inner volume of the arc tube 4 in stages, ranging from 0.2 cc to 1.0 cc as well as changing the amount of enclosed mercury in stages, ranging from 0.5 mg to 2.0 mg. Ten lamps were made for each class.

With five out of the ten lamps for each class, the color temperature at the beginning stage of lighting (i.e. approximately after a 100-hour lighting period) and a rise in lamp voltage (V) from the beginning stage to the end of a 9000-hour lighting period were examined. Each lamp was lit, with the central axis of the lamp being horizontal, using a lighting circuit (for instance, one having a publicly known electronic ballast). The results of the examination are shown in FIG. 3. In addition, with the remaining five lamps, the occurrence of breakage of the outer tube 3 was examined as follows. First, each lamp was lit at the rated current under steady state illumination conditions. Then, an overcurrent of 20 times the rated current was made to flow until the arc tube 4 was forcibly ruptured. Whether the outer tube 3 got broken at this point was checked. The results are also shown in FIG. 3.

As with all prepared lamps, the wall thickness $t_1$ of the outer tube 3 was uniformly set at a constant of 0.9 mm, the wall thickness $t_2$ of the main tube part 6, 1.2 mm, and the length L between the electrodes 14, 32 mm (L/D=8). Regarding to substances enclosed in the arc tube 4, 2.3 mg of praseodymium iodide ($PrI_3$) and 6.7 mg of sodium iodide (NaI) were enclosed. In addition, a xenon gas was also enclosed to be 20 kPa at ambient temperature.

In FIG. 3, values in "COLOR TEMPERATURE (K)" and "LAMP VOLTAGE RISE (V)" are average figures for each class. As to "OCCURRENCE OF OUTER TUBE BREAKAGE", the denominator indicates the total number of lamps examined for a corresponding class while the numerator indicates the number of lamps, out of the total number of the examined lamps, whose outer tube 3 got broken. Values in "VARIATION OF COLOR TEMPERATURE" are obtained by subtracting the minimum from the maximum.

As is clear from FIG. 3, when a relational expression of $R/r \geqq 3.4$ was satisfied, i.e. lamps of all Classes from E to T, a rise in lamp voltage from the beginning stage to the end of a 9000-hour lighting period was suppressed to 27 V or lower, and the occurrence of burnt-out lamps due to the rise in lamp voltage was not observed in these classes. On the other hand, when a relational expression of $R/r<3.4$ was satisfied, i.e. lamps of all Classes from A to D, the rise in lamp voltage became 35 V or higher. It was observed that some of the lamps in these classes burned out due to the lamp voltage rise.

The reasons why such results were obtained are considered as follows. When the relational expression of $R/r \geqq 3.4$ is satisfied, the outer tube 3 and the main tube part 6 are located away from each other and ample space is provided between them. Therefore, in the above examination, a thermal insulation effect on the main tube part 6 was reduced, and accordingly an excessive increase in temperature of the arc tube 4 (the envelope) was suppressed.

As a result, the reaction between the metal halides and the ceramic forming the envelope of the arc tube 4 was restrained, and therefore an increase in liberated iodine within the arc tube 4 was subdued. In fact, according to an analysis on the experimented lamps satisfying $R/r \geqq 3.4$, traces indicating a reaction of the internal surface of the arc tube 4 with the enclosed metal halides were hardly found.

On the other hand, when the relational expression of $R/r<3.4$ is satisfied, the outer tube 3 and the main tube part 6 are located close to each other and restricted space is provided between them. Therefore, it is thought that, in the above examination, a thermal insulation effect on the main tube part 6 was increased, and accordingly an increase in temperature of the arc tube 4 was accelerated. As a result, the metal halides and the ceramic intensely reacted and this led to an increase in liberated iodine within the arc tube 4. According to an analysis on the experimented lamps satisfying $R/r<3.4$, traces that the internal surface of the arc tube 4 intensely reacted with the metal halides were observed. Thus, it has been found that the occurrence of burnt-out lamps due to the rise in lamp voltage can be prevented by satisfying the relational expression of $R/r \geqq 3.4$. As is also clear from FIG. 3, when a relational expression of $R/r \leqq 7.0$ was satisfied, i.e. lamps of all Classes from A to P, a color temperature fell in the range of 3850 K-4280 K, which is close to a set value (4000 K). When a difference in color temperature is 300 K or less, the difference cannot be detected by eyes. In fact, a color temperature in the above range (3850 K-4280 K) is so close to the set value that their difference cannot be distinguished by visual observation. However, when a relational expression of $R/r>7.0$ was satisfied, i.e. lamps of all Classes from Q to T, a color temperature exceeded the set value and reached 4480 K or higher, and the difference with the set value could observed with eyes.

The reasons why such results were obtained are considered as follows. When the relational expression of $R/r>7.0$ is satisfied, the outer tube 3 and the main tube part 6 are located too far away from each other. In the above experiment, this led to a rather excessive decrease in the temperature of the arc tube 4, and accordingly the vapor pressures of the metals enclosed in the arc tube 4 decreased. On the other hand, when the relational expression of $R/r \leqq 7.0$ was satisfied, the arc tube 4 was adequately kept heated and therefore the vapor pressures of the metals were maintained at proper levels. In sum, in order to maintain the vapor pressures of the metals enclosed in the arc tube 4 at proper levels, the arc tube 4 needs to be kept heated to some extent.

Accordingly, it is preferable that the relational expression of $R/r \leqq 7.0$ be satisfied in order to obtain a desired color temperature. It has been confirmed that these results can be obtained not only when the color temperature is set at 4000 K, but also when the color temperature is variously changed by altering the composition of the enclosed substances and their ratio.

As is clear from FIG. 3, in any of Classes where the density M of mercury in the arc tube 4 was 4.0 mg/cc or lower, i.e. Classes A, B, E, F, I, J, M, N, Q, and R, no breakage of outer tube 3 among the five lamps, was observed. On the other hand, in all Classes where the density M of mercury was more than 4.0 mg/cc, i.e. Classes C, D, G, H, K, L, 0, P, S, and T, one or more outer tubes 3 got broken.

Thus, it has been found that, by specifying the density M of mercury to be at 4.0 mg/cc or lower, the breakage of the outer tube 3 caused by the arc tube 4 rupture can be prevented without using a sleeve and such, unlike the conventional metal halide lamp.

The reasons why these results were obtained are considered as follows. Under steady state illumination, the gas pressure within the lamp is dominantly controlled by the vapor pressure of the mercury. When the density M of mercury is 4.0 mg/cc or lower, the vapor pressure of the mercury in the arc tube 4 is also reduced. Therefore, in the above examination, the gas pressure within the lamp was lowered, and even when the arc tube 4 was ruptured, the momentum of the flying broken pieces was not large enough to break the outer tube 3.

On the other hand, when the density M of mercury is more than 4.0 mg/cc, the vapor pressure of the mercury is increased, and accordingly the gas pressure within the lamp becomes high. Therefore, when the arc tube 4 got broken in the above examination, the broken pieces flew with great force so that a large impact was exerted on the outer tube 3. It has been confirmed that the above results are consistently achieved at least when the wall thickness $t_1$ of the outer tube 3 is 0.6 mm or larger and the wall thickness $t_2$ of the main tube part 6 of the arc tube 4 is 1.4 mm or smaller.

As described above, the gas pressure within the lamp under steady state illumination is dominantly controlled by the vapor pressure of the mercury. Therefore, the gas pressure within the lamp is reduced when the density M of mercury is 4.0 mg/cc or lower, or namely when the amount of the enclosed mercury is reduced. Then, the lamp voltage and the lamp power decrease accordingly, which in turn could result in a reduction in the vapor pressures of the enclosed metals. However, individual lamps have different degrees of variation in lamp power, which naturally leads to variation in the vapor pressures of the enclosed metals. Therefore, the present inventors expected that the color temperature would consequently vary.

However, surprisingly, in the case of lamps of Classes E, F, I, J, M, and N, where the density M of mercury was 4.0 mg/cc or lower but a relational expression of $3.4 \leqq R/r \leqq 7.0$ was satisfied, the variation in color temperature among individual lamps was within the range of 50 K-270 K, and thus the variation was insignificant. It is considered that the above results were obtained because the arc tube 4 was adequately kept heated and therefore the vapor pressures of the enclosed metals were maintained at high levels without any downturns. Having insignificant variation in color temperature in the above situation is greatly beneficial to lamps in which metal halides having lower vapor pressures, e.g. praseodymium, cerium, and sodium, are enclosed.

Note that the operational effectiveness described above was examined by using lamps uniformly satisfying a relational expression of L/D=8. However, it has been confirmed that the operational effectiveness can be accomplished if a relational expression of $L/D \geqq 4.0$ is satisfied.

1.2 Length L of the Space between Electrodes 14

Next, the lamp's operational effectiveness in terms of the length L of the space between the electrodes 14 was examined. A plurality of the metal halide lamps of Class F were prepared as follows. A multiple number of groups were set up on the basis of L/D. Specifically speaking, these groups were created by variously changing the length L in stages, ranging from 16 mm to 44 mm, while setting the internal diameter D of the arc tube 4 at a constant of 4 mm. Five lamps were prepared for each group of L/D.

Each of the prepared lamps was lit, with the central axis of the lamp being horizontal, using a lighting circuit. Then, the luminous efficiency (lm/W) and the occurrence of burnt-out lamps after a 100-hour lighting period were examined. The results are shown in FIG. 4.

As to "OCCURRENCE OF BURNT-OUT LAMPS" in FIG. 4, the denominator indicates the total number of lamps examined for a corresponding group while the numerator indicates the number of lamps, out of the total number of the examined lamps, burnt out after a 100-hour lighting period.

As is clear from FIG. 4, in the cases of L/D=4, 8, 10, and 11 where a relational expression of $L/D \geqq 4$ was satisfied, the luminous efficiency after a 100-hour lighting period was 115 lm/W or higher. This is an approximately 28% or more improvement in luminous efficiency compared to a commercially available common ceramic metal halide lamp (90 lm/W-95 lm/W) with high efficiency and high color rendering.

The reasons why such results were obtained are considered as follows. Compared to a conventional lamp, the temperature of the internal surface of the arc tube 4 reached higher, and accordingly the vapor pressures of the metal halides were increased. However, in the case of L/D=11 where a relational expression of L/D>10 was satisfied, one lamp out of five burned out although high luminous efficiency was obtained. This is thought because the length L of the space between the electrodes 14 was too long and therefore the discharge became harder to be maintained. As a result, it is desirable that a relational expression of $L/D \leqq 10$ be satisfied in order to obtain high luminous efficiency as well as facilitate the maintenance of the discharge.

As described above, with the configuration of the metal halide lamp 1 according to the first embodiment of the present invention, the following advantages can be achieved. First, since satisfying the relational expression of $L/D \geqq 4$, the metal halide lamp 1 can obtain high luminous efficiency. Second, even if the temperature of the arc tube 4 rises relatively high due to $L/D \geqq 4$, the present invention is capable of preventing the occurrence of burnt-out lamps caused by a rise in lamp voltage during the life. This is because the metal halide lamp 1 also satisfies relational expressions of $3.4 \leqq R/r \leqq 7.0$ and $M \leqq 4.0$. In addition, the present invention allows for obtaining desired characteristics in the color temperature at the beginning stage of lighting, and further suppresses variations in color temperature among individual lamps. Since the amount of mercury enclosed in the arc tube 4 is reduced, the amount of ultraviolet emitted from the metal halide lamp 1 is cut down, which in turn leads to reducing the effects on the environment. Third, the present invention is capable of preventing, without using a sleeve and such, the breakage of the outer tube 3 caused by the arc tube 4 rupture. Additionally, since the metal halide lamp 1 of the present invention does not require a sleeve, the cost of materials for the sleeve as well as for members supporting the sleeve in the lamp can be eliminated, and this further leads to a reduction in operation cost. Thus, low-cost production can be realized. Furthermore, because there is no sleeve intercepting light emitted from the arc tube 4, a decrease in the total luminous flux of the lamp as well as a degradation of the luminous intensity distribution characteristics can be prevented. In addition, the present invention is free from the problem of the occurrence of defective productions due to the sleeve breakage during transportation of the lamps. Besides, since saving space and weight of the sleeve, the present invention achieves a lighter and smaller metal halide lamp. This results in an improvement of the impact resistance of the metal halide lamp.

It is desirable that the degree of vacuum inside the outer tube 3 be $1\times10^3$ Pa or lower at 300 K. Herewith, it is suppressed that the heat of the arc tube 4 is transferred to the outer tube 3 through the gas enclosed in the outer tube 3 and then released to the outside of the metal halide lamp 1. This, in turn, prevents a decrease in luminous efficiency. On the other hand, when the degree of vacuum inside the outer tube 3 exceeds $1\times10^3$ Pa at 300 K, the heat of the arc tube 4 is transferred to the outer tube 3 through the gas and released to the outside, and consequently the luminous efficiency may possibly decrease.

Figure 5:
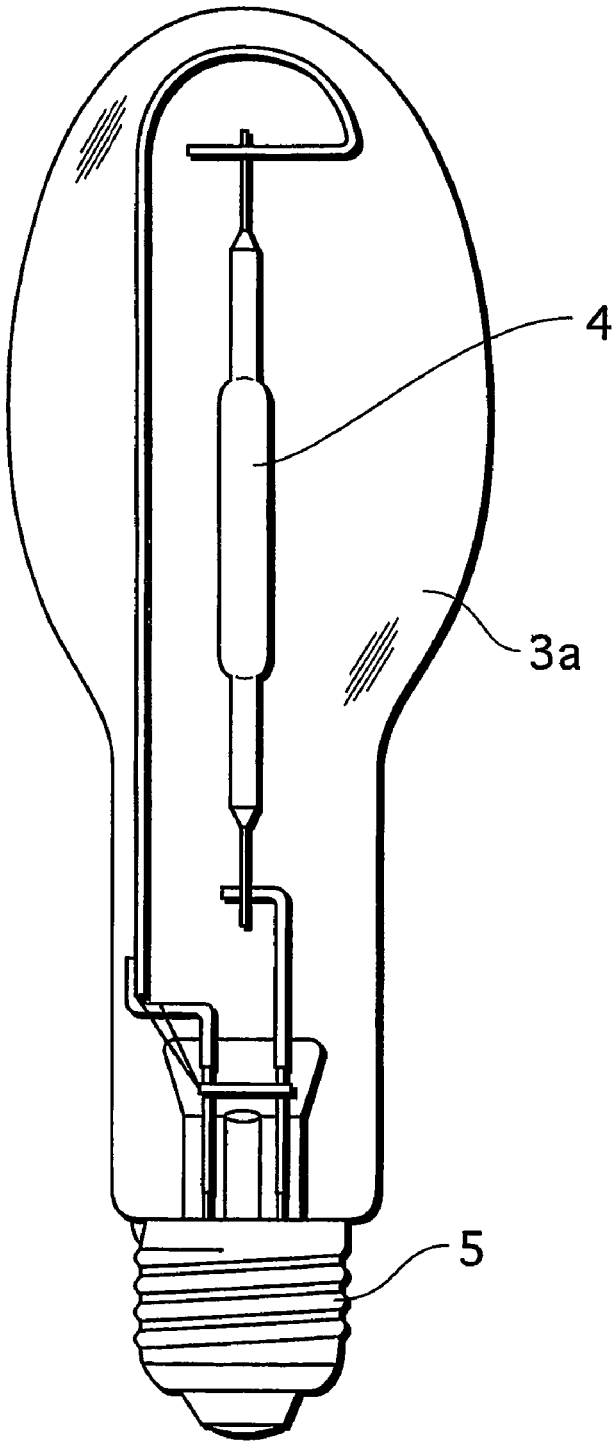
FIG. 5 is a front view of a metal halide lamp whose outer tube has a different shape.

Note that the first embodiment above describes the case in which the outer tube 3 is cylindrical, however, the present invention is not confined to this shape. The same operational effectiveness can be accomplished with, for example, a teardrop-shaped outer tube 3*a* having a bulging portion as shown in FIG. 5.

Figure 6:
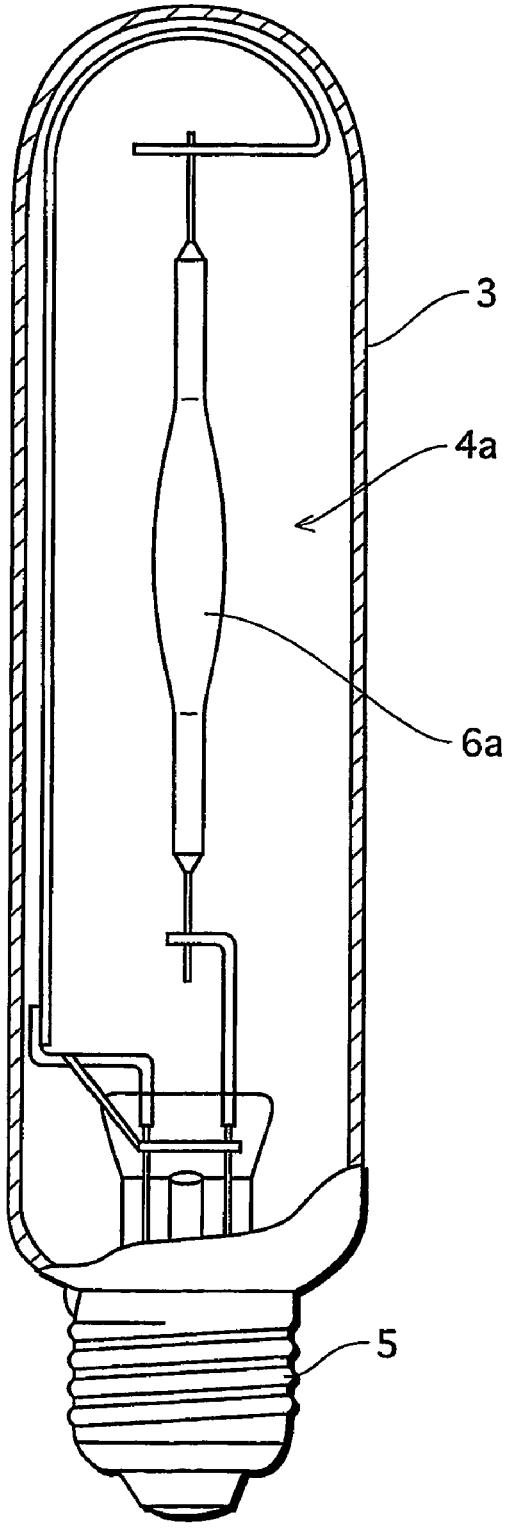
FIG. 6 is a front view of a metal halide lamp whose arc tube has a different shape, with a part cut away to reveal the internal arrangements.

The first embodiment above describes the case in which the arc tube 4 has a cylindrical main tube part 6, however, the present invention is not confined to this. The same operational effectiveness can be accomplished with an arc tube 4*a* whose main tube part 6*a* is, for instance, substantially ellipsoidal as shown in FIG. 6. As a matter of course, in the case where the arc tube 4*a* having the substantially ellipsoidal main tube part 6*a* is set in the teardrop-shaped outer tube 3*a*, the same operational effectiveness above can also be accomplished.

The first embodiment exemplifies the metal halide lamp 1 having rated lamp wattage of 150 W. However, the present invention is applicable to metal halide lamps having rated lamp wattage ranging from 20 W to 400 W.

2. Second Embodiment

Figure 7:
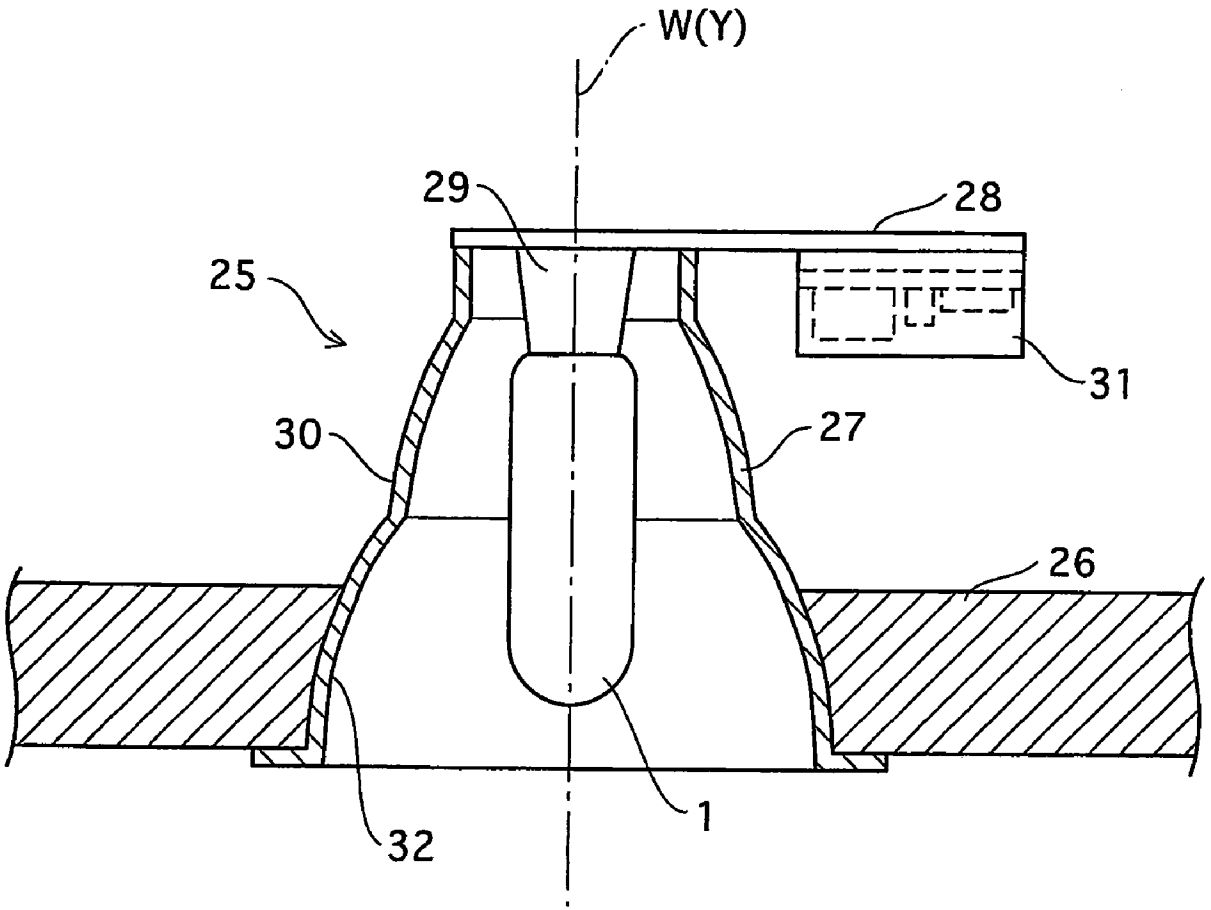
FIG. 7 is a schematic diagram of a luminaire according to a second embodiment of the present invention.

FIG. 7 shows a luminaire 25 according to a second embodiment of the present invention. The luminaire 25 is used, for instance, for ceiling lighting, and comprises a main lighting body 30, the metal halide lamp 1 (rated lamp wattage: 150 W) of the first embodiment, and a lighting circuit 31. The main lighting body 30 is composed of a reflector 27, a base unit 28, and a socket 29. The reflector 27 has an umbrella shape, and is set in a ceiling 26. The base unit 28 has a plate-like shape, and is attached to the bottom plane of the reflector 27. The socket 29 is placed on this bottom plane within the reflector 27. Within the main lighting body 30, the metal halide lamp 1 is attached to the socket 29 in a manner that the central axis Y substantially coincides with the central axis W of the reflector 27. The lighting circuit 31 is placed, on the base unit 28, at a position apart from the reflector 27.

Note that a shape and such of a reflection surface 32 of the reflector 27 are determined case by case in view of the applications and use conditions of the luminaire 25. Although, in the example depicted in FIG. 7, there is no front glass set in front of the reflector 27, such a front glass may be employed according to the uses.

The lighting circuit 31 uses a publicly known electronic ballast. Here, the use of a commonly-used magnetic ballast, instead of the electronic ballast, is not appropriate. As described above, a reduction in the amount of the enclosed mercury leads to a decrease in the lamp voltage, which, in turn, could lead to a decrease in the lamp power. When such a magnetic ballast is employed for the lighting circuit 31, the lamp power is more susceptible to the influence of the decrease in the lamp voltage, and tends to decrease more readily. Besides, a degree of variation in lamp power is different from lamp to lamp. As a result, the vapor pressures of the metals enclosed in the arc tube (not shown) may vary among the lamps, which may lead to variations in color temperature. In the case where the electronic ballast is used, on the other hand, the lamp electric power is kept at constant in a vast range of voltage. Herewith, the temperature of the arc tube is controlled to be constant and the vapor pressures of the enclosed metals are stabilized. This further prevents variations in color temperature among individual lamps.

As described above, the configuration of the luminaire 25 according to the second embodiment prevents the occurrence of burnt-out lamps due to a rise in lamp voltage during the life while obtaining high luminous efficiency since the metal halide lamp 1 of the first embodiment above is used.

In addition, this configuration allows for obtaining desired characteristics in the color temperature at the beginning state of lighting and suppressing variations in color temperature among individual luminaires. As a result, in the case where a plurality of luminaires is used together in the same space, the luminaires are capable of making the entire space having a unified color temperature.

Since the amount of mercury enclosed in the arc tube is reduced, the amount of ultraviolet emitted from the lamp 1 is cut down. This results in preventing a degradation of the main lighting body 30 and such caused by the ultraviolet, and at the same time reducing the effects on the environment.

Additionally, the luminaire 25 of the present invention uses the metal halide lamp 1, which does not require a sleeve. Therefore, the cost of materials for the sleeve as well as members supporting the sleeve in the metal halide lamp 1 can be eliminated, and this leads to a reduction in operation cost. Thus, low-cost production can be realized. Furthermore, because there is no sleeve intercepting light emitted from the arc tube, a decrease in the total luminous flux of the metal halide lamp l as well as a degradation of the luminous intensity distribution characteristics can be prevented.

Note that the second embodiment exemplifies a case in which the luminaire 25 is used for ceiling lighting. However, the present invention is not confined to this use, and can also be applied to other types of interior lighting, store lighting, and street lighting. In addition, the luminaire 25 of the present invention can adopt a variety of publicly known main lighting bodies and lighting circuits according to the uses.

INDUSTRIAL APPLICABILITY

The metal halide lamp and the luminaire of the present invention are applicable to situations where it is necessary to prevent the occurrence of burnt-out lamp during the life due to a rise in lamp voltage as well as to obtain high luminous efficiency at the same time.

The invention claimed is:

1. A metal halide lamp comprising:

an arc tube made of translucent ceramic and having a main tube part in which a pair of electrodes are disposed; and an outer tube housing the arc tube therein, wherein $4.0 \leqq L/D \geqq 10.0$, where L is a length of space between the electrodes and D is an internal diameter of the main tube part, $3.4 \leqq R/r \leqq 7.0$, where R is an internal diameter of the outer tube and r is an external diameter of the main tube part, within a region positionally corresponding to, in a radial direction of the outer tube and the arc tube, the space between the electrodes, on a cross-sectional surface where an outer circumference of the arc tube comes closest to an inner circumference of the outer tube, and $M \leqq 4.0$, where M (mg/cc) is a density of mercury enclosed in the arc tube.

2. The metal halide lamp of claim 1, wherein a sodium halide and at least one of a cerium halide and a praseodymium halide are enclosed in the arc tube.

3. The metal halide lamp of claim 2, wherein a degree of vacuum inside the outer tube is no more than $1\times10^3$ Pa at 300 K.

4. The metal halide lamp of claim 1, wherein a degree of vacuum inside the outer tube is no more than $1\times10^3$ Pa at 300 K.

5. The metal halide lamp of claim 1, wherein an external surface of the arc tube directly faces an internal surface of the outer tube.

6. A luminaire comprising:

a metal halide lamp recited in claim 1; and a lighting circuit for illuminating the metal halide lamp.

* * * * *